US005808402A

United States Patent [19]

Seiler et al.

[11] Patent Number: 5,808,402

[45] Date of Patent: Sep. 15, 1998

[54] DISCHARGE LAMP

[75] Inventors: Hartmut Seiler, Baden-Baden; Bernard Woerner, Reutlingen; Thomas Fabry, Neckartenzlingen, all of Germany

[73] Assignee: Robert Bosch GmbH, Stuttgart, Germany

[21] Appl. No.: 878,142

[22] Filed: Jun. 18, 1997

[30] Foreign Application Priority Data

Jun. 18, 1997 [DE] Germany ..... 196 24 243.6

[51] Int. Cl.[6] ..... H01J 61/00

[52] U.S. Cl. ..... 313/318.01; 313/318.11; 313/25

[58] Field of Search ..... 313/318.01, 318.02, 313/318.07, 318.11, 318.05, 25

[56] References Cited

U.S. PATENT DOCUMENTS 5,250,872 10/1993 Wakimizu et al. ..... 313/318.05

FOREIGN PATENT DOCUMENTS

| | | |
|---|---|---|
| 0 070 548 A2 | 1/1983 | European Pat. Off. . |
| 0 152 649 A1 | 8/1985 | European Pat. Off. . |
| 0 309 041 A1 | 3/1989 | European Pat. Off. . |
| 0 321 866 A2 | 6/1989 | European Pat. Off. . |
| 0 478 058 A1 | 4/1992 | European Pat. Off. . |
| 0 522 362 A1 | 1/1993 | European Pat. Off. . |
| 2 665 022 A1 | 1/1992 | France . |
| 22 46 333 | 3/1974 | Germany . |
| 40 04 823 A1 | 9/1990 | Germany . |
| 4004823A1 | 9/1990 | Germany . |

OTHER PUBLICATIONS

Patent Abstract of Japan, vol. 006, No. 140 E–121, Publication Date Apr. 17, 1982, Inventor Tomita Yoshifumi.

*Primary Examiner*—Nimeshkumar Patel
*Attorney, Agent, or Firm*—Michael J. Striker

[57] ABSTRACT

A discharge lamp, having a base part, a discharge vessel connected with the base part, at least two electrodes arranged in said discharge vessel, the discharge vessel prior to connection with the base part being movable relative to the base part for adjustment, a receiving element fixable on the discharge vessel, an intermediate member formed so that discharge vessel is connectable with intermediate member through receiving element, discharge vessel being movable through receiving element relative to intermediate member for an adjustment, and after a performed adjustment is fixable on intermediate member, intermediate member being movable for an adjustment of discharge vessel relative to the base part and fixable after a performed adjustment on the base part.

17 Claims, 5 Drawing Sheets

DISCHARGE LAMP

BACKGROUND OF THE INVENTION

The present invention relates to discharge lamps.

Discharge lamps are known in the art. One of such discharge lamps is disclosed in the German patent document DE 40 04 823 A1. The discharge lamp has a base part and discharge vessel connected with it and accommodating at least two electrodes. The discharge vessel must be connectable through conduits to its electrodes with the contacts arranged on the base part. In order to provide adjustment of the discharge vessel, it must be movable in a substantial way relative to the base part. Depending on the manufacturing tolerances, the arrangement of the electrodes in the discharge vessel deviates from a predetermined correct arrangement which must be provided in operation of the discharge lamp between light arc formed by the electrodes relative to the base part. For compensating these deviations, the adjustment of the discharge vessel relative to the base part is provided, so that the electrodes and the light arc formed between them assume the predetermined position relative to the base part. With discharge vessels with arrangements of the electrodes which substantially deviate from the required position there are difficulties to provide a movability in the desired degree when the discharge vessel is directly connected with the base part.

SUMMARY OF THE INVENTION

Accordingly, it is an object of the present invention to provide a discharge lamp which avoids the disadvantages of the prior art.

In keeping with these objects and with others which will become apparent hereinafter, one feature of the present invention resides, briefly stated, in a discharge lamp in which a receiving element is fixable on the discharge vessel for connection of the discharge vessel with an intermediate member, the discharge vessel is movable through the receiving element relative to the intermediate member for its adjustment, and after the performed adjustment is fixable on the intermediate member and the intermediate member is movable relative to the base and fixable after the performed adjustment on the base for adjusting the discharge vessel.

When the discharge lamp is designed in accordance with the present invention, the discharge vessels with arrangement of the electrodes which substantially deviate from the required position can be adjusted so that its electrodes assume the required position relative to the base part. This is performed in such a way that the movability of the discharge vessel is subdivided for its adjustment into several components, and on the one hand the discharge vessel with the receiving element is movable relative to the intermediate member while on the other hand the intermediate member is movable relative to the base part.

In accordance with another feature of the present invention the receiving element is formed as a leg spring clampable on the discharge vessel. With this construction the receiving element is simple and easily mountable on the discharge vessel.

In accordance with a further feature of the present invention, the receiving element has at least approximately spherical outer contour. In this case an especially simple adjustment of the intermediate member relative to the base part is possible.

In accordance with still further features of the present invention, the intermediate member has a flange with which it abuts against an abutment surface of the base part. The flange of the intermediate member and the abutment surface of the base part can be arranged at least approximately perpendicular to the longitudinal axis of the discharge vessel. With this construction an especially simple contact of at least one electrode of the discharge vessel is possible.

At least one of the electrodes of the discharge lamp can be electrically connected with the intermediate member composed of metal. Therefore, the receiving element simultaneously can operate as an auxiliary electrode, with which the electrical voltage required for ignition of the discharge lamp can be reduced.

At least one of the electrodes of the discharge vessel can be electrically conductively connected with the base part composed of metal. Therefore, the discharge vessel is surrounded by an electric field, by which the positively charge ions are held far from the wall of the discharge vessel and driven back to the light arc, so that a length of the service life of the discharge lamp can be increased.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
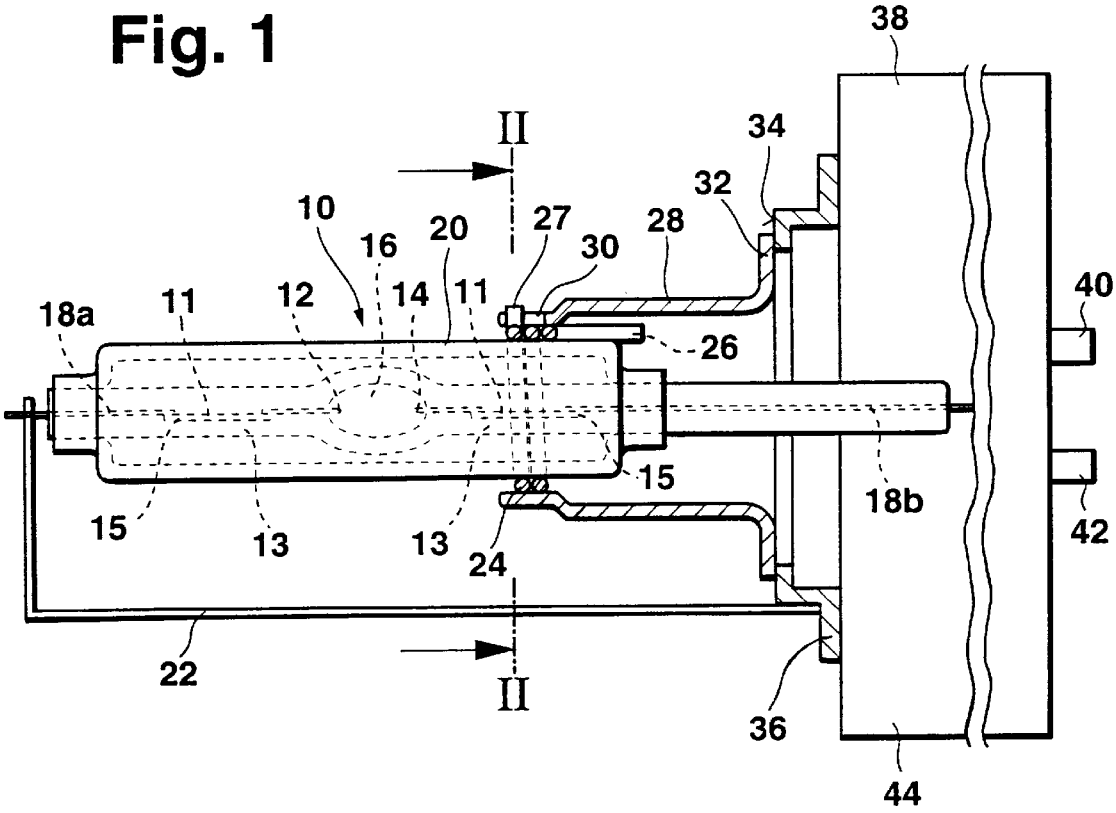
FIG. 1 is a view showing a discharge lamp in a longitudinal section in accordance with a first embodiment of the invention.

A discharge lamp shown in FIGS. 1–10 is provided in particular for the utilization in headlights of motor vehicles. The discharge lamp has a discharge vessel 10 accommodating at least two electrodes 12 and 14. The discharge vessel 10 is composed for example of glass, in particular quartz glass. It has a hollow burner portion 16 in which the ends of the electrodes 12, 14 are inserted. The burner 16 contains a filler of noble gas, for example xenon, and mercury, as well as in some cases metal halogenides. Tubular portions 18*a, b* are connected with the burner 16 and surrounds the electrodes 12, 14 or conductors to the electrodes 12, 14. The discharge vessel 10 can also have a bulb jacket 20 which surrounds the burner 16 as well as the tubular portions 18*a, b* and it at least partially screens the light arc which is formed for example during the operation of the discharge lamp between the electrodes 12, 14 and in addition to visible light, irradiates UV-radiation.

The electrodes 12, 14 as well as their conductors extend at least approximately in a longitudinal axis 11 of the discharge vessel 10 and has ends extending outwardly of the tubular portion 18*a, b.* The conduits are connected with the electrodes 12, 14 through molybdenum foil 15. The tubular portions 18*a, b* are gas-tightly squeezed for sealing of the burner 16 in the region 13 of the molybdenum foil 15. A tubular conductor 22 is connected with the end of the front electrode 12 which extends outwardly of the tubular portion 18 and is spaced from the base of the discharge lamp. The return conductor 22 leads to the base part. The end of the electrode 14 which is closer to the base and extends outwardly of the tubular portion 18*b* is connected with a contact element or an electrical pre-switching device arranged in the base part.

Figure 2:
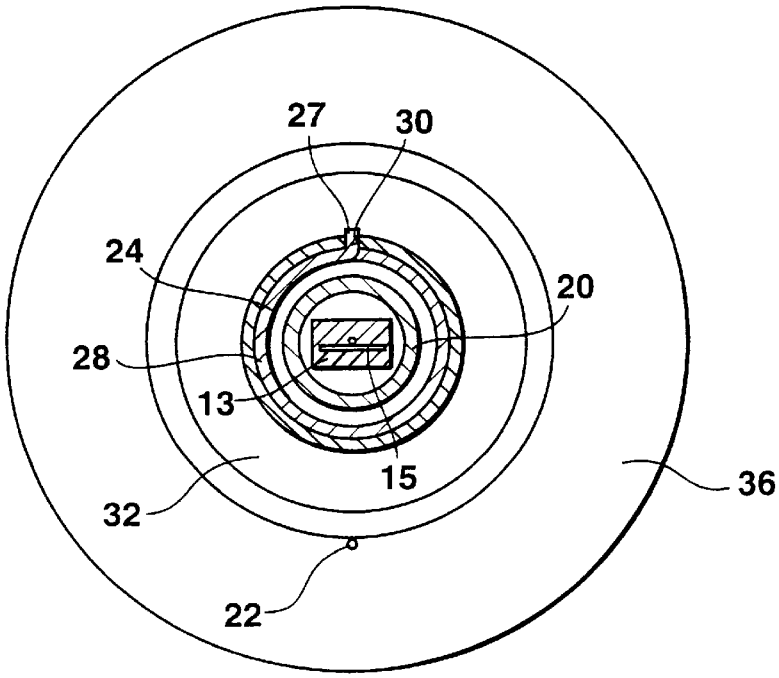
FIG. 2 is a view showing a cross-section of the discharge lamp taken along the line II—II.

FIGS. 1 and 2 show a discharge lamp in accordance with a first embodiment of the invention. A receiving element 24 is mounted on the discharge vessel 10, in particular on its bulb jacket 20. The receiving element 24 is formed preferably as a leg spring which is composed of a spring wire and has only several convulsions, for example only one convulsion. The leg spring 24 can be expanded by compression of its both ends 26, 27. Therefore its inner diameter is increased, and in this position, it can be fitted on the discharge vessel 10. When the ends are again released, the inner diameter of the leg spring 24 again reduces and it is clamped on the discharge vessel 10 so as to be firmly held. With a corresponding winding of the leg spring 24, it is expanded for its mounting during pulling apart, instead of a compression of its end. An end 26 of the leg spring 24 can be arranged for example substantially along the discharge vessel 10, while the other end 27 can be outwardly bent substantially radial to the discharge vessel 10.

The discharge vessel 10 has a region in which the receiving element 24 is arranged. The discharge vessel is insertable with this region into an intermediate member 28. The intermediate member 28 can for example be sleeve-shaped and composed preferably of metal. The sleeve 28 has a front end with which it is insertable in the discharge vessel 10, and this front end has a smaller cross-section than its another end facing the base. The sleeve 28 can be provided in its front end with a groove 30, in which the end 27 of the receiving element 24 can be inserted. Through the receiving element 24, during the mounting of the discharge lamp, its discharge vessel 10 can be turned for adjustment in the sleeve 28 around axes extending transversely to its longitudinal axis 11, and moreover can be turned in direction of the longitudinal axis 11. After the performed adjustment, or in other words when the electrodes 12, 14 of the discharge vessel 10 assume the required position relative to the sleeve 28, the receiving element 24 is fixed on the sleeve 28, and this can be performed for example by welding of this parts. Also, several welding points can be provided over the periphery of the sleeve 28. The discharge vessel 10 together with the sleeve 28 form a pre-mountable unit. The sleeve 28 can expand to the vicinity of the burner 16. However, it is arranged so that the light radiation from the light arc formed in the burner 16 is not prevented.

Figure 3:
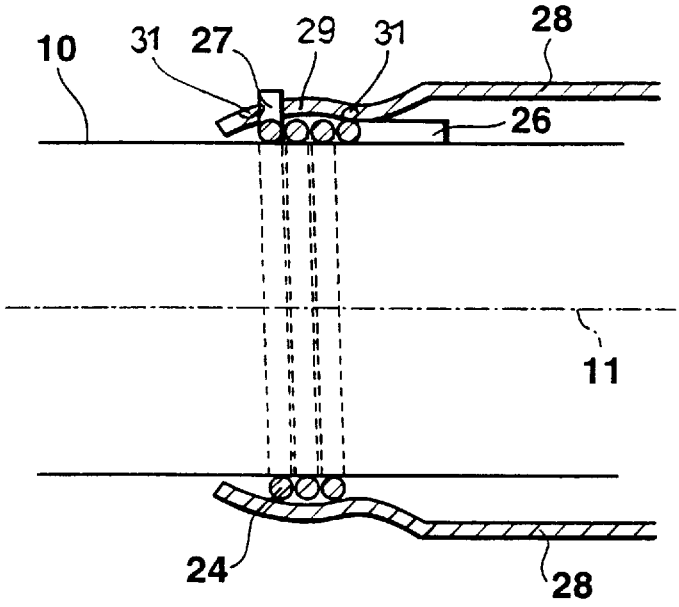
FIG. 3 is a view showing the discharge lamp in a longitudinal section in accordance with a second embodiment.

FIG. 3 shows the discharge lamp in accordance with the second embodiment. Here the sleeve 28 on its end region 29, in which the receiving element 24 is inserted, is formed at least approximately in the shape of a spherical shell. The receiving element 24 has also an outer contour which is at least approximately spherical, so that it is turnably received in the end region 29 of the sleeve 28. Thereby a tension-free turning of the receiving element 24 together with the discharge vessel is possible. Reference numeral 31 identifies points, at which the receiving element 24, after a performed adjustment is welded for example with the end region 29 of the sleeve 28.

Figure 4:
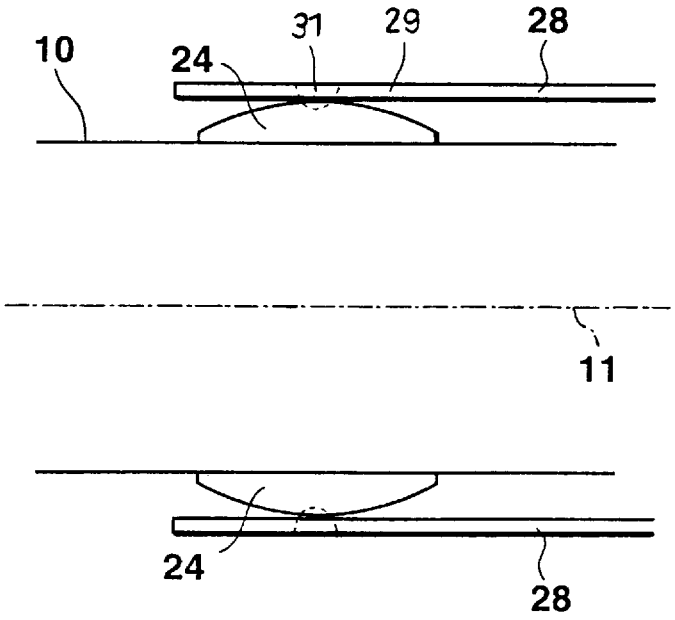
FIG. 4 is a view showing the discharge lamp in a longitudinal section in accordance with the third embodiment.

The discharge lamp in accordance with a third embodiment is shown in FIG. 4. Here the receiving element 24 has an outer contour which is substantially spherical, while the end region 29 of the sleeve 28, in which the receiving element 24 is inserted, is substantially cylindrical. Also, in this embodiment the receiving element 24 together with the discharge vessel can be turnable without tension in the sleeve 28 for its adjustment. Reference numeral 31 identifies points, at which preferably a welding of the receiving element 24 with the end region 29 of the sleeve 28 is performed after the adjustment.

The sleeve 28 at its end facing the base is provided with a flange 32 which extends radially to the longitudinal axis 11 of the discharge vessel 10 and extends outwardly. The flange 32 of the sleeve 28 can come to abutment against an abutment surface 34 of a plate-shaped base part 36. The abutment surface 34 can be arranged on a projection of the base part 36 which extends toward the discharge vessel 10. For an adjustment of the discharge vessel 10, the sleeve 28 together with the discharge vessel 10 is movable with its flange 32 on the abutment surface 34 of the base part 36 in directions perpendicular to the longitudinal axis 11. The base part 36 is composed preferably of metal, and the sleeve 28 is fixed on it after the performed adjustment of the discharge vessel 10, by welding through its flange 32. Several welding points can be provided over the periphery of the sleeve 28.

The return conductor 22 conducted with the electrode 12 can be electrically conductively connected with the base part 36. Between the base part 36 and its connection to the electrode 12, the return conductor 22 can be provided with an insulation or can be not insulated. The return conduit 22 is also electrically conductively connected with the intermediate member 28 which is composed of metal, through the base part 36 which is also composed of metal. Thereby the adjustment of the discharge vessel 10 relative to the base part 36 is performed through two components. Namely, on the one hand the discharge vessel 10 can be adjusted through the receiving element 24 relative to the intermediate member 28, and on the other hand through the intermediate member 28 relative to the base part 36. Thereby initially substantial deviations of the position of the electrodes 12, 14 of the discharge vessel 10 can be compensated.

The discharge lamp is inserted through the base part 36 into the headlight, in particular a reflector of the headlight. The base part 36 can be inserted directly or through a lamp carrier into a receptacle of the reflector. The receptacle is exactly oriented relative to the reflector. With the adjustable position of the discharge vessel 10 relative to the base part 36, the light arc which is formed during the operation of the discharge lamp in the burner 16 between the ends of the electrodes 12, 14 assumes a predetermined position relative to the reflector. Thereby the light emitted by the discharge lamp can be reflected by the reflector in a predetermined way.

Further components can be connected with the base part 36 and together with the base form the gas discharge lamp. A housing part 38 can be connected for example with the base part 36, and the electrical connecting contact 40, 42 can be arranged on it. They are connected with the electrodes 12, 14. A plug part can be connected with the connecting contact 40, 42 for connecting the discharge lamp with a current supply or an electrical pre-switching device. An ignition device 44 is integrated in the base of the discharge lamp for producing a high voltage required for ignition of the discharge lamp. The ignition device 44 has a transformer. Its primary side, or in other words a low voltage side is connected with the current supply, for example a board system of the vehicle. Its secondary side or in other words high voltage side is connected with the electrode 14.

Figure 5:
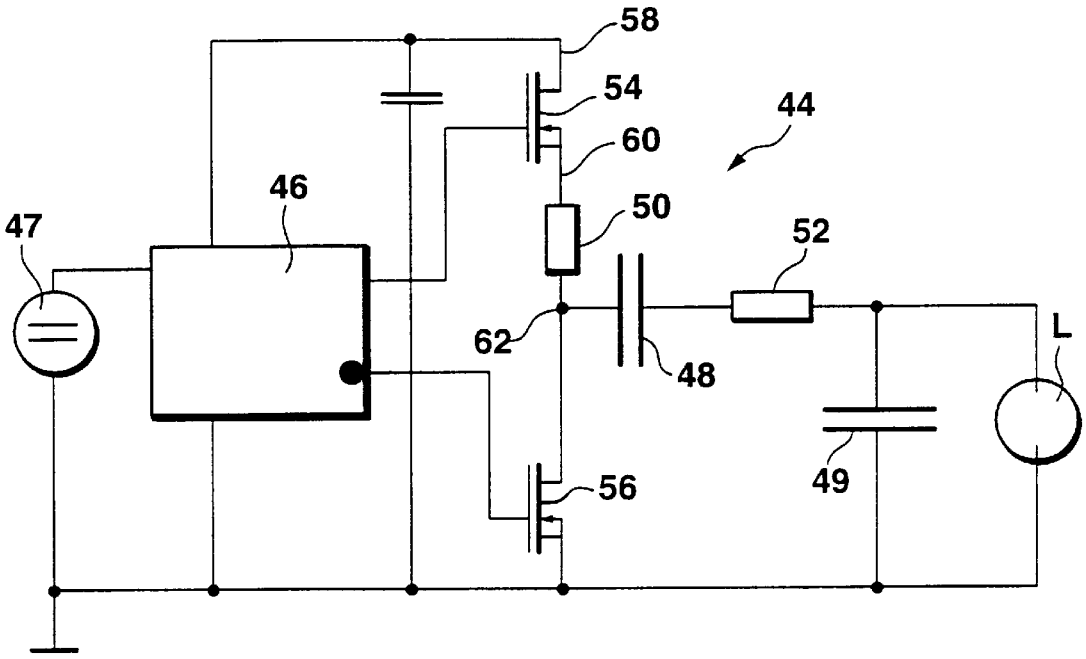
FIG. 5 is a view showing a circuit of an electrical pre-switching device for operation of the discharge lamp.
Figure 6:
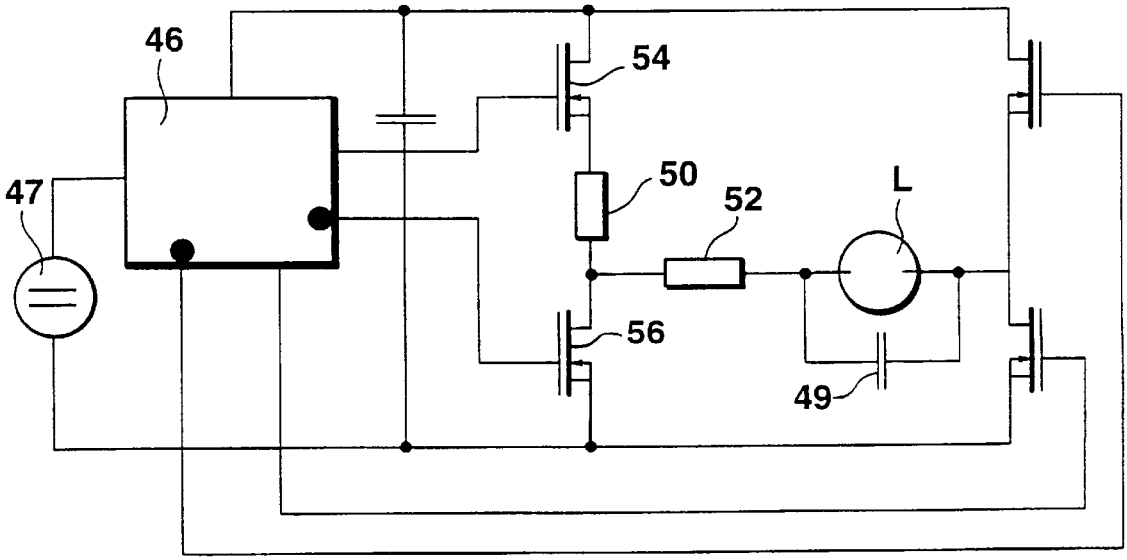
FIG. 6 is a view showing a modified circuit of the electrical pre-switching device.

A circuit for electrical pre-switching device is shown in FIG. 5. It has the previously described ignition device 44. The pre-switching device also has a control device 46 which controls the operation of the discharge lamp after its ignition. The control device 46 is connected with the board battery 47 of the vehicle. The ignition device 44 also has, in addition to the transformer, a coupling capacitor 48 as well as a further capacitor 49 parallel to the discharge lamp L, which together with the secondary inductivity of the transformer form an electrical resonant circuit. The transformer has a primary winding 50 and a secondary winding 52. The transformer can be formed as a tesla-transformer. Its both windings 50, 52 are air coils, and the primary winding 50 has relatively less windings while the secondary winding 52 has relatively more windings. The coupling capacitor 48 is connected in series between the primary winding 50 and the secondary winding 52 of the transformer. The discharge lamp A is controlled by transistor semi-bridge. A first transistor 54 is connected before the primary winding 50 of the transformer, and a secondary transistor 56 is connected after the secondary winding 52 parallel to the coupling capacitor 58. As shown in FIG. 6, an ignition device is possible with which, instead of a transistor semi-bridge and a coupling capacitor, a transitor full bridge is provided. The second bridge branch is then connected with the connecting point of the resonant circuit capacitor 49 with the discharge lamp L.

When the receiving element 24 composed of a metal is electrically conductively connected through the intermediate member 28 composed of metal with the return conductor 22 of the electrode 12, it can operate as an ignition electrode. Thereby the voltage required for ignition of the discharge lamp can be reduced. The return conductor 22 can be directly connected with the intermediate member 28 or the base part 36 composed of metal, and through it can be connected with the intermediate member 28 and the receiving part 24.1 For the ignition voltage-reducing operation of the receiving element 24 it is sufficient when it is connected in a high-frequency way with a potential in the vicinity of the electrical potential of the return conduit 22. This potential must be substantially smaller by a tenth power than the ignition voltage of the discharge lamp. For example, the potential of the receiving element 24 during an ignition voltage of the discharge lamp is substantially 8 kV smaller or equal 800 V. This is achieved for example by a capacitive coupling of the receiving element 24 with the return conductor 22.

The intermediate member 28 can be alternatively connected with an electrical potential, which during the operation of the discharge lamp is always higher than the corresponding positive potential connected with the electrodes 12, 14. In this case, the intermediate member 28 is not electrically conductively connected with the return conductor 22. A possible potential, with which the intermediate member 28 can be connected, is for example the positive supply connection 58 of the inverse rectifier. The inverse rectifier is composed of the ignition device 44 as well as both transistors 54, 56 and loaded with the alternating voltage of the discharge lamp. A further possible potential with which the intermediate member 28 can be connected, is the supply connection 60 of the primary winding 50 of the transformer or the connecting point 62 of the primary winding 50 of the transformer 44 with the coupling capacitor 48.

Figure 7:
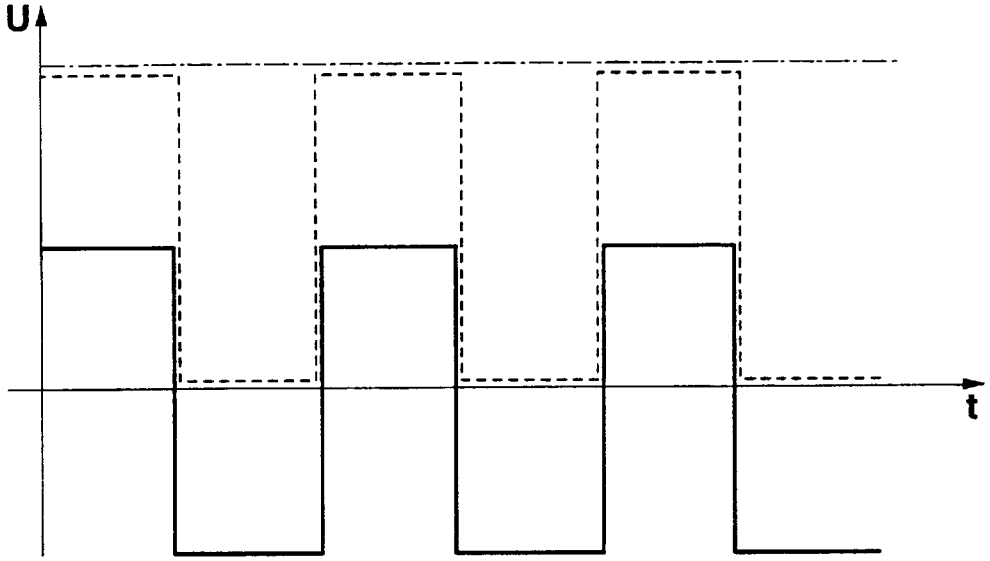
FIG. 7 is a view showing a time course of an electrical potential at a different point of the pre-switching device.

FIG. 7 shows a time course of the potential at the above mentioned points, as well as the time course of the potential at the discharge lamp. The solid lines show the course of the potential U at the discharge lamp, while broken lines show the course of the potential U at the above mentioned points 60 and 62, while the dash-dot line show the course of the potential U at the supply connection 58 of the inverse rectifier. The constant voltage of the board system is provided at the supply connection 58, or the constant voltage produced by the control device 56. At the points 60 and 62, an alternating voltage is provided, which fluctuates between zero and the previously provided supply voltage. At the discharge lamp, an alternating current is provided. When the negative potential is at the discharge lamp, the potential at the points 60 and 62 is zero and thereby it is more positive than the potential at the discharge lamp.

With the above explained provision for a potential at the intermediate member 28 which is always more positive than the potential at the discharge lamp, the discharge device 10, in particular its burner 16, is surrounded by an electrical field through which the positively charged ions are held far from the wall of the burner 16 and driven back to the light arc. Thereby a longer service life of the discharge lamp is provided.

Figure 8:
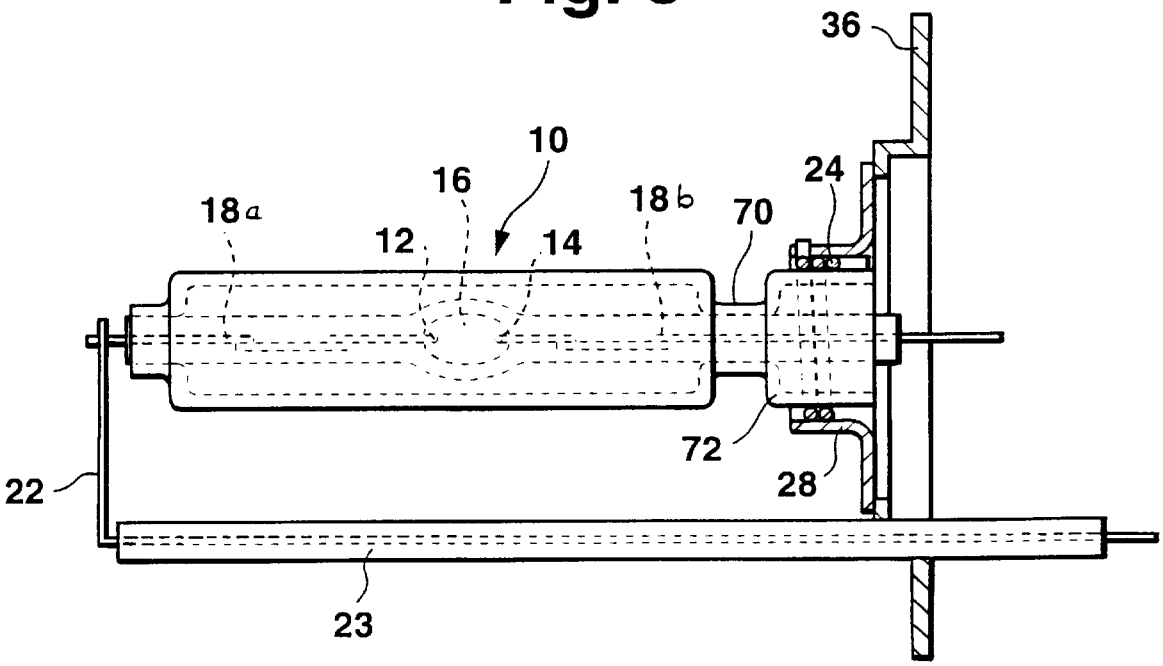
FIG. 8 is a view showing the discharge lamp in the longitudinal section in accordance with a fourth embodiment of the invention.

FIG. 8 shows the discharge lamp in accordance with a fourth embodiment. Here the discharge vessel 10 is provided in which both electrodes 12, 14 are arranged and their ends extend into the burner 16. Conductors to the electrodes 12, 14 are arranged in tubular portions 18. The return conductor 28 is connected at the end of the conductor to the electrode 12. At the end of the conductor to the electrode 14, the above mentioned plug contact 40, 42 or a connection to the previously described electrical pre-switching device is provided. The bulb cover 20 has, after the burner 16, a narrowing toward the base part 36. It is connected with the narrowing mechanically for stabilization of the tubular portion 18*b*. The bulb cover 20 at the narrowing 70 to the base part 36 has a portion 72 which extends substantially with the same diameter as in the region of the burner 16. The receiving element 24 described with respect to the first embodiment is arranged on the portion 72 of the bulb cover 20 and is associated with the intermediate member 28. The intermediate member 28 is again connected with the base part 36 so that the intermediate member 28 and the base part 36 are substantially formed as in the first embodiment.

The return conductor 22 is provided with an insulation 23 and connected not electrically conductively with the base part 36 or the intermediate member 38 but instead with the plug contact 40, 42 or the electrical pre-switching device. The mounting of the discharge lamp and the adjustment of the discharge vessel 10 are the same as in the first embodiment. Preferably in this embodiment the receiving element 24 and the intermediate member 28 are thermally less loaded than in the first embodiment, since lower temperatures are available on the portion 72 of the bulb cover 20 than in the region of the burner 16. The construction of the receiving element 24 and/or the sleeve 28 are the same as shown in FIGS. 3 and 4.

Figure 9:
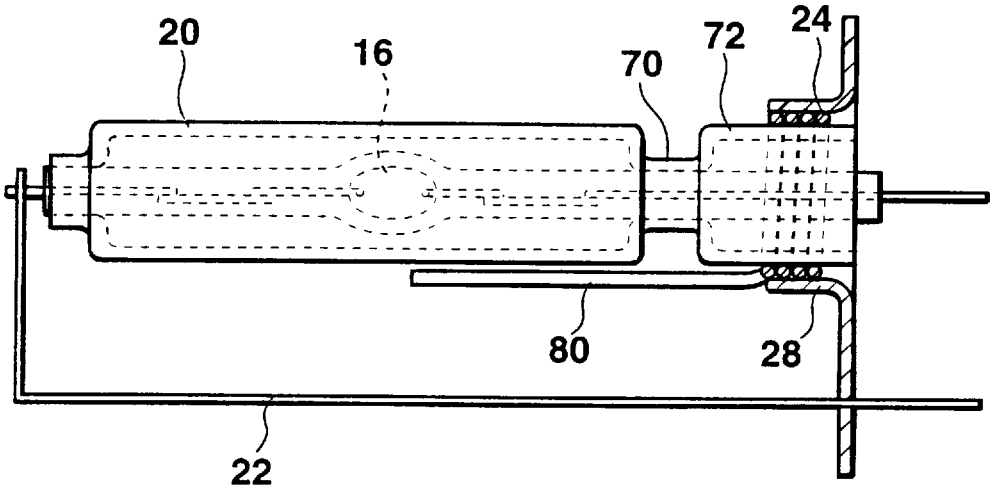
FIG. 9 is a view showing a longitudinal section of a discharge lamp in accordance with a fifth embodiment of the invention.

FIG. 9 shows the discharge lamp in accordance with a fifth embodiment which substantially corresponds to the fourth embodiment. However, the receiving element 24 is formed as a leg spring and arranged on the portion 72 of the bulb cover 20. It has an end 80 extending through the narrowing 70 outwardly toward the burner 16. The end 80 extends substantially parallel to the longitudinal axis 11 on the outer periphery of the bulb cover 20 to the height of the burner 16. The end 80 of the receiving element 24 can operate as an ignition electrode, so that a reduction of the ignition voltage required for ignition of the discharge lamp can be provided. For maintaining low optical disturbances caused by the end 80 it extends preferably in the vertical longitudinal central plane which contains the longitudinal axis 11, or under the bulb cover 20. The receiving element 24 is therefore at least in a high-frequency way on an electrical potential in the vicinity of the potential of the return conductor 22.

Figure 10:
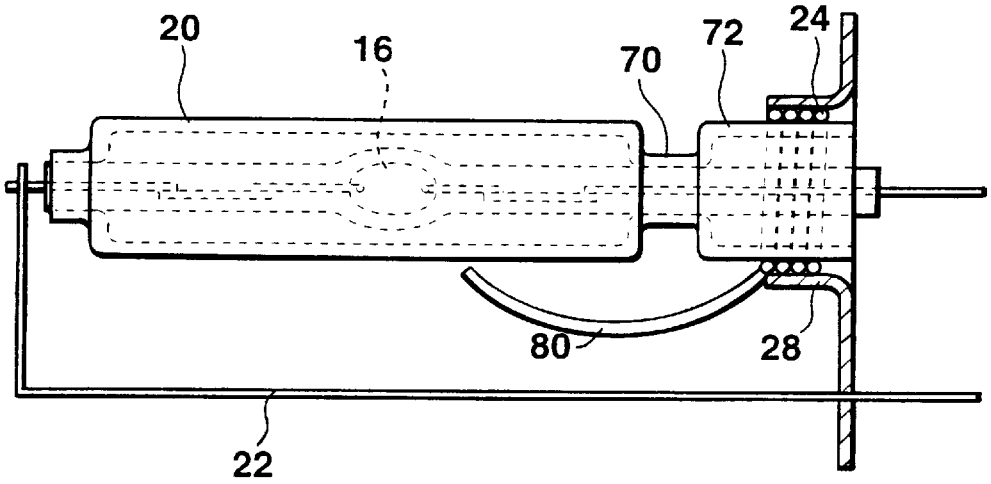
FIG. 10 is a view showing a discharge lamp in a longitudinal section in accordance with a sixth embodiment of the present invention.

FIG. 10 shows the discharge lamp in accordance with a sixth embodiment. In this embodiment, when compared with the fifth embodiment, only the shape of the end 80 of the receiving element 24 which extends from the burner 16 is modified. The end 80 extends from the bulb cover 20 so that it is convexly curved back, and extends with its free end to the bulb cover 20 in the region of the burner 16. In this embodiment of the receiving element 20 also a reduction of the ignition voltage required for the ignition of the discharge lamp is provided.

It will be understood that each of the elements described above, or two or more together, may also find a useful application in other types of constructions differing from the types described above.

While the invention has been illustrated and described as embodied in discharge lamp, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A discharge lamp, having a base part; a discharge vessel connected with said base part; at least two electrodes arranged in said discharge vessel, said discharge vessel prior to connection with said base part being movable relative to said base part for adjustment; a receiving element fixable on said discharge vessel; an intermediate member formed so that said discharge vessel is connectable with said intermediate member through said receiving element, said discharge vessel being movable through said receiving element relative to said intermediate member for an adjustment, and after a performed adjustment is fixable on said intermediate member, said intermediate member being movable for an adjustment of said discharge vessel relative to said base part and fixable after a performed adjustment on said base part.

2. A discharge lamp as defined in claim 1, wherein said discharge vessel is turnable for the adjustment through said receiving element relative to said intermediate member about an axis extending transversely to a longitudinal axis of said discharge vessel and is displaceable in direction of said longitudinal axis.

3. A discharge lamp as defined in claim 1, wherein said intermediate member for the adjustment of said discharge vessel relative to said base part is displaceable relative to the longitudinal axis of said discharge vessel.

4. A discharge lamp as defined in claim 1, wherein said receiving element is formed as a leg spring which is clampable on said discharge vessel.

5. A discharge lamp as defined in claim 1, wherein said intermediate member is sleeve-shaped, said discharge vessel being insertable through said receiving element into said intermediate member.

6. A discharge lamp as defined in claim 1, wherein said receiving element has at least a substantially spherical outer contour, through which it is turnably insertable into said intermediate member.

7. A discharge lamp as defined in claim 6, wherein said intermediate member has a substantially spherical-shell-shaped region in which said receiving element is insertable.

8. A discharge lamp as defined in claim 1, wherein said receiving element and said intermediate member are composed of metal and after the performed adjustment of said discharge vessel said receiving element is fixable by welding on said intermediate member.

9. A discharge lamp as defined in claim 1, wherein said intermediate member and said base part are composed of metal and after the performed adjustment of said discharge vessel, said intermediate member is fixable on said base part by welding.

10. A discharge lamp as defined in claim 1, wherein said base part has an abutment surface, said intermediate member having a flange which abuts against said abutment surface of said base part.

11. A discharge lamp as defined in claim 10, wherein said flange of said intermediate member and said abutment surface of said base part are arranged at least substantially perpendicular to a longitudinal axis of said discharge vessel.

12. A discharge lamp as defined in claim 1, wherein said intermediate member is composed of metal, at least one of said electrodes of said discharge vessel being electrically conductively connected with said intermediate member.

13. A discharge lamp as defined in claim 1, wherein said base part is composed metal, at least one of said electrodes of said discharge vessel being electrically conductively connected with said base part.

14. A discharge lamp as defined in claim 1, wherein said receiving element is composed of metal and electrically conductively connected with at least one of said electrodes of said discharge vessel.

15. A discharge lamp as defined in claim 1, wherein said intermediate member is composed of metal and connected with an electrical potential which, during operation of the discharge lamp, is always higher than an electrical potential at said electrodes of said discharge lamp in time means.

16. A discharge lamp as defined in claim 15; and further comprising an electrical pre-switching device having an inverse rectifier for supplying said electrodes of said discharge vessel with alternating voltage, said intermediate member being connected with a positive supply connection of said inverse rectifier.

17. A discharge lamp as defined in claim 15; and further comprising a pre-switching device including an ignition device with a transformer, said intermediate member being connected with a primary side of said transformer.

* * * * *